United States Patent [19]

Timony

[11] Patent Number: 4,530,772

[45] Date of Patent: Jul. 23, 1985

[54] METHOD OF ELECTRICAL CONTACT LUBRICATION

[75] Inventor: Peter E. Timony, Valley Cottage, N.Y.

[73] Assignee: Stauffer Chemical Company, Westport, Conn.

[21] Appl. No.: 582,351

[22] Filed: Feb. 22, 1984

[51] Int. Cl.[3] ..... C10M 1/26; C10M 3/20

[52] U.S. Cl. ..... 252/56 S; 252/32.5; 252/50

[58] Field of Search ..... 252/32.7 E, 56 S, 50, 252/32.5

[56] References Cited

U.S. PATENT DOCUMENTS

| | | | |
|---|---|---|---|
| 3,875,069 | 4/1975 | Worschech et al. | 252/56 S |
| 4,036,771 | 7/1977 | Denis | 252/56 S |
| 4,061,581 | 12/1977 | Leleu et al. | 252/56 S |

OTHER PUBLICATIONS

G. Kovacs, "Lubricants for Electrical Contacts Used in Telecommunications", *Proc. Int. Conf. Electr. Contact. Phenom.*, 10th, 1980, 1, 475–488.

*Chemical Abstracts* 172412 p (1981) abstracting Jpn. Tokkyo Koho 81/23480.

*Chemical Abstracts* 172427 x (1981), abstracting Jpn. Kokai Tokkyo Koho 81/82894.

W. O. Freitag, "Lubricants for Separable Connectors":, *Electr. Contacts, Proc. Annu. Holm. Semin.* 1976, 22, 57–63.

W. E. Campbell, "The Lubrication of Electrical Contacts", *IEEE Trans. on Components, Hybrids,* and *Manufacturing Technology,* vol. No. 1, Mar. 1978, 4–16.

R. V. Steenstrup et al., "A Comparative Study of Inhibited Lubricants for Dry Circuits Sliding Contacts", *IEEE Transactions on Components, Hybrids and Manufacturing Technology,* vol. CHMT-6, No. 1, Mar. 1983, 37–44.

*Primary Examiner*—Jacqueline V. Howard

*Attorney, Agent, or Firm*—Richard P. Fennelly

[57] ABSTRACT

An electric contact lubricant is disclosed which comprises a partially crosslinked polyol ester formed by esterification of an aliphatic monocarboxylic acid with an aliphatic polyol in the presence of a dibasic acid crosslinker, a phosphate ester fluid, and one or more corrosion and oxidation inhibitor compounds.

9 Claims, No Drawings

METHOD OF ELECTRICAL CONTACT LUBRICATION

BACKGROUND OF THE INVENTION

The present invention relates to an electrical contact lubricant and to a method of lubrication using it.

Electrical contact lubricants are specialized products which require certain characteristics: good metal wetting properties; good electrical properties; an acceptable degree of high temperature oxidative stability; good corrosion resistance; and lack of undesired reactivity in regard to materials adjacent to the electric contact assembly itself. Various types of lubricants have been suggested for such end use applications.

A lubricant for electric contacts comprising a high-stability perfluorinated polyether and an originally wax-like fraction of a perfluorinated hydrocarbon is described in Proc. Int. Conf. Electr. Contact Phenom., 10th, 1980, 1, 475–488. Japanese Tokkyo Koko 81/23,480 describes a lubricating grease for electrical contacts containing pure mineral oil, a lithium soap, and magnesium hydroxide. Japanese Kokai Tokkyo Koko 81/82,894 advocates a siloxane based lubricant containing smaller amounts of powdered silicon dioxide, an aliphatic aluminum salt, and a sulfur-containing lubricity improver. A lubricant composition formed by blending dicarboxylic esters, e.g., bis(2-ethylhexyl) adipate, with derivatives of pyrazolidone and/or triazoles is suggested in French Pat. No. 2,493,335. Various polyphenyl ethers, natural and synthetic hydrocarbons, esters, polyglycols, fluorinated materials, silicones, and proprietary formulations were reported as being tested as lubricants for separable connectors in Electr. Contacts, Proc. Annu. Holm Semin. 1976, 22, 57–63.

SUMMARY OF THE PRESENT INVENTION

The present invention relates to an electrical contact lubricant and its use to lubricate electrical contacts. The lubricant of the present invention contains a predominant amount of a partially cross-linked polyol ester in combination with a small amount of a triaryl phosphate fluid.

DETAILED DESCRIPTION OF THE PRESENT INVENTION

The major component of the present lubricant is a partially crosslinked polyol ester which is the esterification reaction product of an aliphatic monocarboxylic acid and an aliphatic polyol in the presence of a minor amount of a dibasic acid as a crosslinking agent.

The aliphatic monocarboxylic acids used in accordance with this invention are compounds or mixtures of compounds having average chain lengths of from about 4 to about 12 carbon atoms, preferably from about 5 to about 9 carbon atoms. The individual acids can range in chain length from about 2 to about 18 carbon atoms. Normal acids are preferred, although branched monocarboxylic acids can also be used, particularly those with no more than two carbon atoms in side chains.

In synthesizing the partially crosslinked polyol esters, minor amounts (e.g., from about 0.1 to about 10%, by weight of the polyol) of dibasic acids are employed as crosslinking agents in order to increase (or build) the viscosity of the normal, uncrosslinked polyol ester. The alkyl or aryl portion of the dibasic acid generally ranges from about 2 to about 18 carbon atoms, more preferably from about 4 to about 12 carbon atoms. Particularly preferred dibasic acids include adipic, azelaic, isophthalic, and mixtures thereof. Also included for purposes of crosslinking are the dimer and trimer acids and mixtures thereof.

The polyols used are those having at least two, and preferably at least three, methylol groups on a quaternary carbon atom. Among the polyols which can be used are trimethylolpropane, trimethylolethane, neopentyl glycol, pentaerythritol, 2-butyl-2-ethyl-1,3-propanediol, 2,2,4-trimethyl-1,3-pentanediol, and mixtures thereof.

Also included within the definition of polyols are those polyols which are formed from either condensation of two or more polyols within the definition above, provided that no more than four polyol units are so condensed and further provided that at least four OH groups are available.

Generally speaking, the polyol ester component of the present lubricant will comprise a predominant portion of the lubricant composition. Representative amounts range from about 93% to about 97%, by weight.

Another component of the present lubricant which is used in much lower amount than the partially cross-linked polyol ester is a triaryl phosphate fluid such as tricresyl phosphate. It is present at from about 0.1%–5%, preferably 1–3%, by weight of the composition. It contributes to the desired degree of fluid cleanliness when the lubricant is used by possibly passivating such metal species as iron. It also aids in lubricating the contacts, and it has an affinity for metal surfaces which is also desired.

In addition to the foregoing products, the composition advantageously also contains one or more oxidation and corrosion inhibitors to give the final composition the desired degree of oxidation and corrosion inhibition. The total weight for these ingredients can range from about 1%–3%.

Organic compounds which contain sulfur, nitrogen, phosphorus or alkylphenols and which have utility in inhibiting oxidation in polyol ester lubricant fluids can be used in conjunction with the present invention. Preferred are aromatic amine oxidation inhibitors, particularly those of the formula

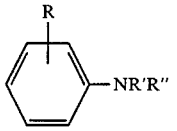

where R can be hydrogen or alkyl, R′ can be hydrogen or alkyl, and R″ can be hydrogen, phenyl, naphthyl, aminophenyl or alkyl substituted phenyl. The size of the alkyl moiety can range from 1 to about 8–10. Representative compounds include N,N′-dioctyldiphenylamine, 4-octyl-N-(4-octylphenyl)benzenamine, and phenyl-alpha-naphthylamine. Representative amounts can range from about 0.1% to about 2%.

A corrosion inhibitor for the metal forming the electric contact (e.g., copper) can also be included in the lubricant composition of the present invention. Representative amounts range from about 0.005% to about 0.1% with such compounds as the dialkyl thiadiazoles, benzotriazole, purpurxanthrene, anthrarufin, and chrysazin being useful.

The following Examples illustrate certain embodiments of the present invention.

EXAMPLE 1

This Example illustrates formation of the electrical contact lubricant composition of the present invention.

The following ingredients were blended in the weights given below to form the composition. The pentaerythritol ester was charged into a blending vessel equipped with heating and stirring devices. This base oil was then heated with agitation as all the preweighed additives were added. Heating and agitation were continued until the additives were completely dissolved about 30 minutes with a maximum temperature of 105° C. Stirring continued as the blend was allowed to cool. Cooling under agitation was continued until a safe handling temperature was attained. The product was then filtered (10μ) into the final containers.

| Ingredient | Parts By Weight | Approx. % By Weight |
|---|---|---|
| Pentaerythritol ester of $C_7$ acid crosslinked with azelaic acid (BASE STOCK 810 from Stauffer Chemical Company) | 3839.2 | 95.98 |
| Natural cresylic acid based tricresyl phosphate (SYN-O-AD 8484 from Stauffer Chemical Company) | 80.0 | 2.0 |
| Benzotriazole corrosion inhibitor | 0.80 | 0.02 |
| 4-octyl-N—(4-octylphenyl)benzenamine oxidation inhibitor (VANLUBE 81 brand from R. T. Vanderbilt and Co.) | 40.0 | 1.0 |
| Phenyl-alpha-naphthylamine corrosion inhibitor | 40.0 | 1.0 |
| Silicone antifoam (SWS 101 brand from SWS Silicones) | 10 parts by weight per million based on entire composition. | |

The composition described above had the following physical properties:

| Properties | | Value |
|---|---|---|
| Viscosity (in cs) | at 210° F. (98.9° C.) | 11.34 |
| | at 100° F. (37.8° C.) | 76.66 |
| | at 0° F. (−17.8° C.) | 3692.2 |
| Pour Point | (°F.) | −34. |
| | (°C.) | −36.7 |
| Evaporation Rate (% Loss) at 300° F. (148.9° C.) - 22 hours | | 0.4 |
| Acid number (mg KOH/gm) | | 0.09 |
| Auto Ignition temp. | (°F.) | 865. |
| | (°C.) | 462.8 |
| Flash Point | (°F.) | 545. |
| | (°C.) | 285. |
| Fire Point | (°F.) | 615. |
| | (°C.) | 323.9 |

EXAMPLE 2

Listed below are some additional physical performance data for the composition described in Example 1.

Oxidation - Corrosion

Federal Standard Test Method 791a, Method 5308

| | 72 Hr. (174° C.) 347° F. | 48 Hr. (218.3° C.) 425° F. |
|---|---|---|
| 100° F. (37.8° C.) Viscosity Increase, % | 3.4 | 13.5 |
| Δ TAN | 0.24 | 1.71 |
| Metal Corrosion, mg/cm$^2$ | | |
| Magnesium | −0.05 | −0.24 |
| Steel | −0.05 | +0.10 |
| Aluminum | +0.01 | +0.05 |
| Silver | 0 | +0.08 |
| Copper | +0.10 | 0 |
| % Insolubles | NIL | 1.0 |

Volatility

| Test Method: | ASTM D972 |
|---|---|
| Duration: | 6.5 Hours |
| Temperature, °F. | % Loss |
| 300 (148.9° C.) | 0.09 |
| 350 (176.7° C.) | 0.34 |
| 400 (204.4° C.) | 1.1 |

The foregoing Examples illustrate certain embodiments of the present invention but should not be construed in a limiting sense. The scope of protection sought is set forth in the claims which follow.

What is claimed:

1. A method for the lubrication of electric contacts which comprises adding thereto a lubricant consisting essentially of a predominant amount of a partially crosslinked polyol ester, which is the esterification reaction product of an aliphatic monocarboxylic acid and an aliphatic polyol in the presence of a dibasic acid crosslinker, a lesser amount of a phosphate ester fluid and at least one inhibitor compound.

2. A method as claimed in claim 1 wherein the monocarboxylic acid has an average chain length of from about 4 to about 12 carbon atoms and the polyol has at least two metholol groups on a quaternary carbon atom.

3. A method as claimed in claim 1 wherein the monocarboxylic acid has a chain length of about seven and the polyol is pentaerythritol.

4. A method as claimed in claim 1 wherein the dibasic acid crosslinker has an alkyl portion of from about 2 to about 18 carbon atoms.

5. A method as claimed in claim 1 wherein the dibasic acid crosslinker is azelaic acid.

6. A method as claimed in claim 1 wherein the lubricant comprises from about 93% to about 97%, by weight, of the partially crosslinked polyol ester, from about 1% to about 3%, by weight, of the triaryl phosphate fluid, and from about 1% to about 3% by weight of the inhibitor compound.

7. A method as claimed in claim 6 in which the ester is the pentaerythritol ester of a $C_7$ acid crosslinked with azelaic acid and the phosphate ester fluid is a triaryl phosphate.

8. A method as claimed in claim 6 wherein the inhibitor compound is selected from benzotriazole, phenyl alpha naphthyl amine, and mixtures thereof.

9. A method as claimed in claim 6 wherein the inhibitor compound is 4-octyl-N-(4-octylphenyl)benzenamine.

* * * * *